United States Patent [19]

Jundt et al.

[11] 4,130,101

[45] Dec. 19, 1978

[54] TRANSISTORIZED IGNITION SYSTEM FOR INTERNAL COMBUSTION ENGINES

[75] Inventors: Werner Jundt, Ludwigsburg; Bernd Bodig, Leinfelden; Gerhard Söhner, Remshalden; Walter Ruf, Korntal-Munchingen; Helmut Roth; Peter Werner, both of Stuttgart, all of Germany

[73] Assignee: Robert Bosch GmbH, Stuttgart, Germany

[21] Appl. No.: 707,323

[22] Filed: Jul. 21, 1976

[30] Foreign Application Priority Data

Jul. 24, 1975 [DE] Fed. Rep. of Germany ..... 2533046

[51] Int. Cl.[2] ..... F02P 9/00; F02P 11/00

[52] U.S. Cl. ..... 123/148 E; 315/209 T

[58] Field of Search ..... 123/148 E, 148 S

[56] References Cited

U.S. PATENT DOCUMENTS 3,745,985 7/1973 Hohne ..... 123/148 S 3,972,315 8/1976 Munden et al. ..... 123/148 E 4,010,726 3/1977 Kondo ..... 123/148 S

*Primary Examiner*—Stephen C. Bentley

*Assistant Examiner*—Thomas H. Webb

*Attorney, Agent, or Firm*—Flynn & Frishauf

[57] ABSTRACT

To provide for gradual turn-off of an ignition coil current control transistor, a control capacitor which provides turn-off current has its charge state changed gradually by means of an auxiliary transistor so connected to the capacitor that the conduction of the emitter-collector path of the auxiliary transistor is gradually changed, the main switching transistor being connected to and controlled by the auxiliary transistor and likewise changing gradually from conductive to blocking state in dependence on the gradual change in conduction of the emitter-collector path of the auxiliary transistor to prevent rapid turn-off of the main switching transistor and hence an undesired pulse at the secondary of the ignition coil which may induce continued operation of the internal combustion engine even though the ignition has been turned off.

11 Claims, 5 Drawing Figures

TRANSISTORIZED IGNITION SYSTEM FOR INTERNAL COMBUSTION ENGINES

CROSS REFERENCE TO RELATED APPLICATION

Figure 1:
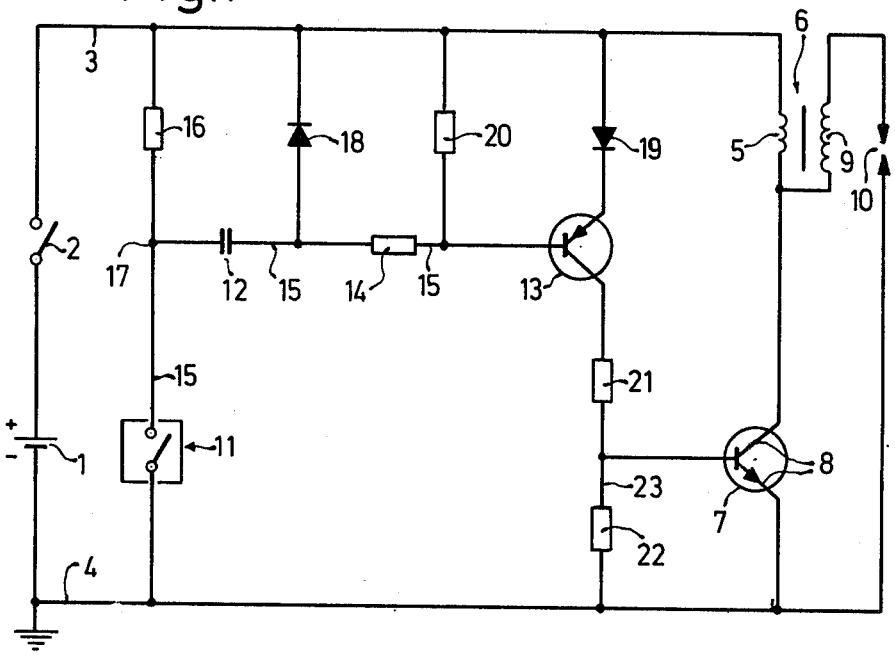

U.S. Ser. 707,320, filed July 21, 1976, and assigned to the assignee of the present application.

The present invention relates to an ignition system for internal combustion engines annd more particularly to a transistorized ignition system using an ignition coil in which a main switching transistor controls current flow through the ignition coil.

Ignition systems using ignition coils have the advantage of simplicity and reliability. The current flow through the coil can be controlled by a switching transistor which is rendered conductive to store energy in the coil and then is suddenly changed to blocking or non-conductive state. If the internal combustion engine is to be stopped, control of the switching transistor is effected by a charge stored in a control capacitor. The control capacitor then provides for changing the switching path of the main switching transistor to blocked state. Thus, when the engine is stopped, current flow through the primary winding of the ignition coil is likewise blocked so that excessive heating of the ignition coil and possible damage thereto or destruction thereof can be avoided, since current flow through the coil is automatically interrupted when the engine does not operate.

Ignition systems of this type have previously been proposed (see German Disclosure Document DT-OS 2,047,586) in which a control capacitor is constantly charged when current is to be supplied; it is discharged in synchronism with the ignition events. When the internal combustion engine is stopped and further ignition events are no longer controlled and current continues to be supplied, the voltage at the control capacitor suddenly rises above a predetermined value which is the threshold value of a Zener diode. When this threshold value is exceeded, the base-emitter path of an auxiliary transistor - not normally concerned with controlling the ignition transistor - is energized, annd the emitter-collector path of the auxiliary transistor short-circuits the base-emitter of a further coupling transistor which, in turn, controls the main switching transistor to blocked state. This interrupts flow of current in the primary winding of the ignition coil rapidly, however, so that an additional spark can be generated in a spark plug, possibly causing undesired continued operation of the internal combustion engine.

It is an object of the present invention to provide an ignition system of the type referred to in which undesired continued operation of the internal combustion engine is reliably inhibited.

SUBJECT MATTER OF THE PRESENT INVENTION

Briefly, the turn-off control capacitor has a system connected thereto which provides for gradual changeover of the main switching transistor from conductive to blocking state and thus prevents induction of a high-voltage pulse in the secondary of the coil after the engine has stopped. This system includes an auxiliary transistor which is so connected to the control capacitor that it gradually changes its conduction, that is, the conduction of the emitter-collector path. The auxiliary transistor is connected to the main switching transistor to so control the main switching transistor that, in accordance with the gradual change in conduction of the emitter-collector path of the auxiliary transistor, the main switching transistor likewise gradually changes state. Since the turn-off of the main switching transistor will not be rapid but gradual, a spurious spark at the spark plug will be inhibited.

The invention will be described by way of example with reference to the accompanying drawings, wherein:

FIG. 1 is a schematic circuit diagram of the basis system in accordance with the present invention; and FIGS. 2 to 5 are schematic diagrams illustrating different embodiments embodying the inventive concept.

The ignition system illustrated in FIG. 1 is particularly applicable to automotive-type internal combustion engines, for example supplied from a vehicle battery 1 forming a direct current source. The source 1 has its positive terminal connected through an ignition switch 2 to a main positive bus 3; its negative terminal is connected to a chassis or ground bus 4. Positive bus 3 is connected to the primary winding 5 of an ignition coil 6 and then through the emitter-collector path, forming the switching path 8, of a main transistor 7, the emitter of which is connected to chassis. A branch between the junction of primary winding 5 and the main switching path 8 of transistor 7 is connected to one terminal of secondary 9 of ignition coil 6, the "hot" terminal of which is connected to a spark plug 10, if desisred through a distributor (not shwn) as well known.

A repetitively opening and closing breaker switch 11 controls the conduction state of path 8 of transistor 7. The breaker switch 11 can be a cam-controlled ignition breaker contact assembly, the emitter-collector path of a transistor controlled to become conductive or to block in accordance with the opening and closing of the mechanical breaker contact, a suitably controlled transistor, the conduction of which is determined by a countactless transducer, of the like; control may depend on the angular position of the crankshaft of the internal combustion engine. The switch 11 can be a direct emitter-collector path of a transistor, or may be combined with threshold switches, such as Schmitt trigger circuits and/or one or more monostable multivibrators.

A control capacitor 12 is used to change the switching state of the switching path 8 in blocked or opened switching condition if the IC engine is stopped and the ignition switch should be closed, while initially, the switching path 8 was conductive. A spurious spark is prevented by gradually changing the charged state at the capacitor 12 and by gradually changing the conductivity of an auxiliary transistor 13; the switching path 8 is likewise gradually changed in dependence on the gradual change of the conductivity of the emitter-collector path of the auxiliary transistor 13.

Switch 11, capacitor 12 and a charging resistor 14 are all connected in series annd form a control connection 15 extending from positive bus 3 to negative or chassis bus 4 which additionally includes the emitter-base junction of auxiliary transistor 13. Switch 11 additionally forms a series circuit with a resistor 16 connected between positive bus 3 and chassis 4. The tap or junction point 17 between switch 11 and resistor 16 forms the control connection portion to the circuit 15. Diode 18, connected in blocking direction, is connected between the junction of capacitor 12 and resistor 14 and positive bus 3.

The control series circuit 15 can be traced as follows: Source 1, bus 3, diode 19, poled in conductive direction, emitter-base path of pnp auxiliary transistor 13, resistor 14, capacitor 12, switch 11, and return to chassis bus 4. A calibrating resistor 20 is connected to the junction between the base of transistor 13 and resistor 14 as well as to positive bus 3.

Two serially connected resistors 21, 22 are connected between the collector of auxiliary transistor 13 and chassis bus 4. The junction 23 between the resistors 21, 22 is connected to the base of main ignition transistor 7.

Operation: The system is ready to operate when ignition switch 2 is closed. When IC engine has started and breaker switch 11 is closed, current will flow over diode 19, the emitter-base junction of auxiliary transistor 13, charging resistor 14, capacitor 12 and switch 11. Transistor 13 thus will become conductive and current will then flow through diode 19, the emitter-collector path of auxiliary transistor 13, resistor 21, and the base-emitter junction of transistor 7. This renders transistor 7 conductive, closing the path 8, and current will flow through primary 5 of ignition coil 6.

At the ignition instant, switch 11 opens. The emitter-collector path of auxiliary transistor 13 and hence transistor 7 are thus blocked. Interruption of current through primary 5 induces a high-voltage pulse in the secondary 9, causing sparking of spark plug 10.

Let it be assumed that ignition switch 11 remains open; capacitor 12 can then discharge through diode 18 and resistor 16. Upon re-closing of switch 11, the cycle will repeat.

If the IC engine does not operate, yet switch 2 is closed and breaker switch 11 is closed, the charge current flowing through capacitor 12 will gradually decrease; this charge current flows as follows: Diode 19, emitter-base junction of transistor 13, resistor 14, capacitor 12; junction 17 and switch 11(closed). In dependence on the gradually decreasing charge current, the emitter-collector path of auxiliary transistor 13, and hence the switching path of transistor 8 changes gradually to blocked state. This change is so slow that the decrease in current in primary winding 5 does not induce a high-voltage pulse in secondary winding 9, thus not causing arc-over at spark plug 10. The transition of the switching path 8 from current carrying to current blocking state should be so arranged that it occurs at approximately the end period upon change in charge state of capacitor 12. The time constants of capacitor 12 and the resistor 14 are therefore so arranged that, even at lowest operating speed of the IC engine, the emitter-collector path of auxiliary transistor 13 and hence of the switching path 8 remains conductive for a sufficient period of time. Diode 18 provides relatively rapid discharge of capacitor 12 over resistor 16. The discharge time constant may be less, but may not be greater than the charging time constant.

The voltage at the emitter of auxiliary transistor 13 is clamped by means of diode 19 in such a manner that the emitter-collector path will reliably block.

Figure 2:
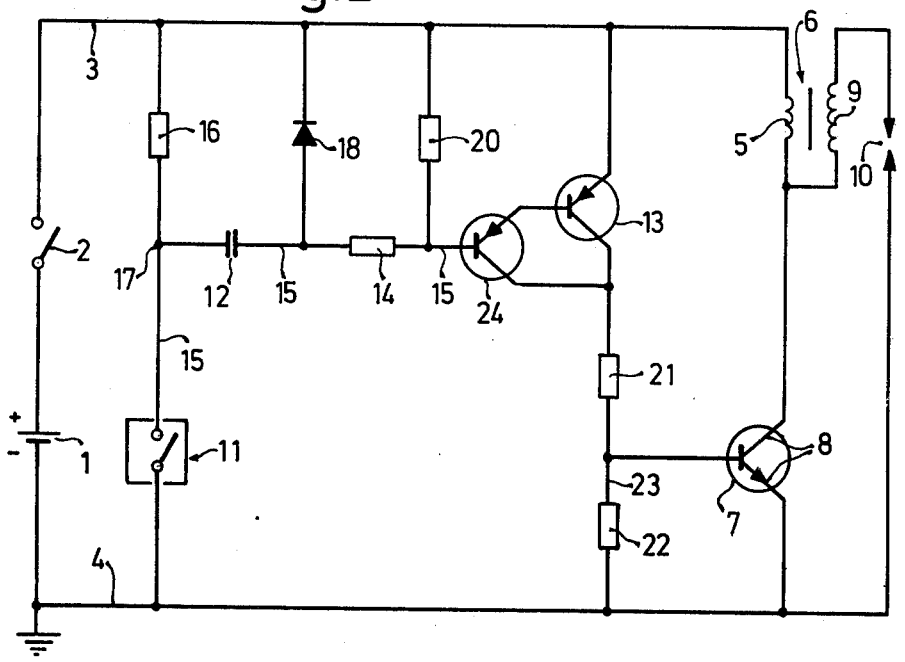

Embodiment of FIG. 2: A further drive transistor 24 is included between the base of auxiliary transistor 13 and the charge resistor 14, so that, effectively, transistors 13, 24 form a Darlington circuit.

The operation of the embodiment of FIG. 2 is identical to that of FIG. 1 and similar parts have been given the same reference numerals. The embodiment of FIG. 2 has the advantage that a lower value of capacity for capacitor 12 can be used, and the charge resistor 14 can be given a higher value, thus resulting in lower costs for the construction of the system.

Figure 3:
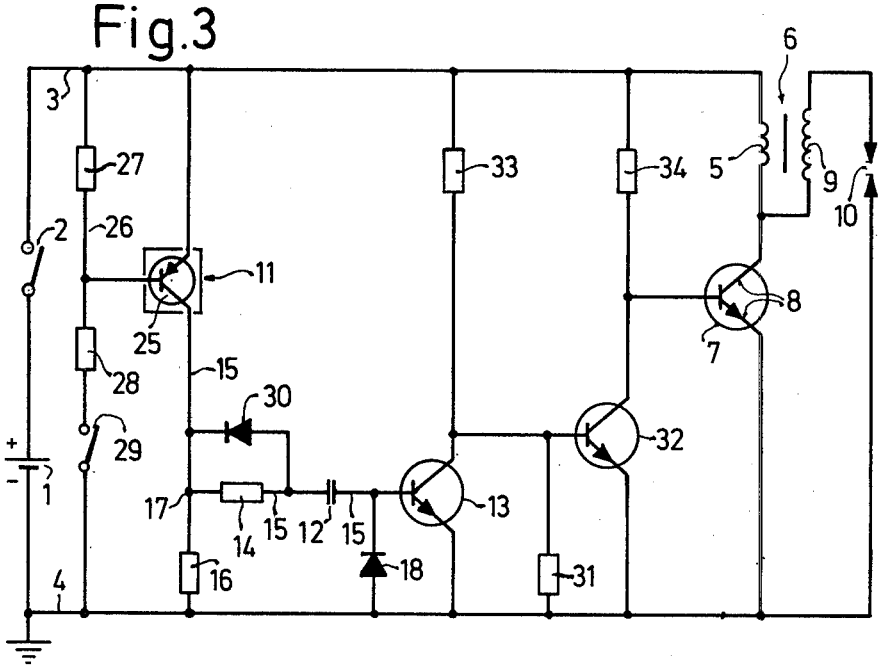

Embodiment of FIG. 3: The breaker switch 11 is formed by the emitter-collector path of a transistor 25, the base of which is connected to the junction 26 of two resistors 27, 28 connected in series with the breaker switch 29 itself. The series connection of resistors 27, 28 and breaker switch 29 is connected between buses 3, 4. The control connection 15 from positive bus 3 is also slightly differently arranged by being connected first through switch 11, then through charge/discharge resistor 14, capacitor 12, and then over the base-emitter path of auxiliary transistor 13 which, in this embodiment, is of the npn type. The capacitor 12 is discharged through diode 18, the anode of which is connected to negative bus 4 and the cathode to the junction between the base of transistor 13 and capacitor 12. Resistor 16 is serially connected between the collector of transistor 25 and chassis bus 4. Charge resistor 14 is bridged by diode 30 poled in blocking direction with respect to source 1. The collector of the auxiliary transistor 13 is connected through a collector resistor 33 to bus 3 and through a resistor 31 to bus 4, as well as to the base of an npn coupling transistor 32, the collector of which is connected both to the base of transistor 7 and through resistor 34 to positive bus 3. The emitter of transistor 32 is connected to chassis bus 4.

Operation of the circuit of FIG. 3: Let it be assumed that switch 2 is closed, the IC engine is starting, and switch 29 has just closed. Current will flow through the emitter-collector path of transistor 25, so that the switch 11, formed thereby, is current-carrying. This charges capacitor 12 though switch 11, resistor 14, and the base-emitter junction of auxiliary transistor 13. Transistor 13 will thus be controlled to be conductive, the emitter-collector path of transistor 32 will block, and transistor 7 will become conductive. Current flow through primary winding 5.

Switch 29 opens at the ignition instant, causing opening of the emitter-collector path of transistor 25 forming switch 11. This causes blocking of auxiliary transistor 13, and conduction of the emitter-collector path of coupling transistor 32, annd consequent blocking of switch 8 of transistor 7. Current through primary 5 is interrupted and a spark will be induced through coil 9 at spark plug 10.

If the breaker switch 29 remains open, the switch 11, hence, in current-blocking state, capacitor 12 can discharge over diode 18, diode 30, and resistor 16.

If the engine does not operate, but the switch 2 is closed and switch 11 is in closed state, the current flowing through switch 11, resistor 14, capacitor 12 and transistor 13 will gradually decrease in accordance with the charge on the capacitor 12. Resistor 14 will now be part of the discharge circuit for capacitor 12. In dependence thereon, the emitter-collector path of transistor 13 will slowly change to blocking state, causing corresponding slow change of the emitter-collector path of the coupling transistor 32 to conductive state and hence of the main switching path 8 slowly into blocking state. This change-over will occur so slowly that the decrease in current in the primary winding does not induce a high-voltage pulse in secondary 9 and thus does not generate an additional spark at spark plug 10. The charge and discharge time constants can be similarly dimensioned as those of FIG. 1.

The system of FIG. 3 is particularly suitable for contact-controlled transistorized ignition systems since the breaker switch 29 is not used directly as the control switch 11. Thus, changes in the contact resistance due to contamination, dirt, or other causes will not affect the charge and discharge time of capacitor 12.

Figure 4:
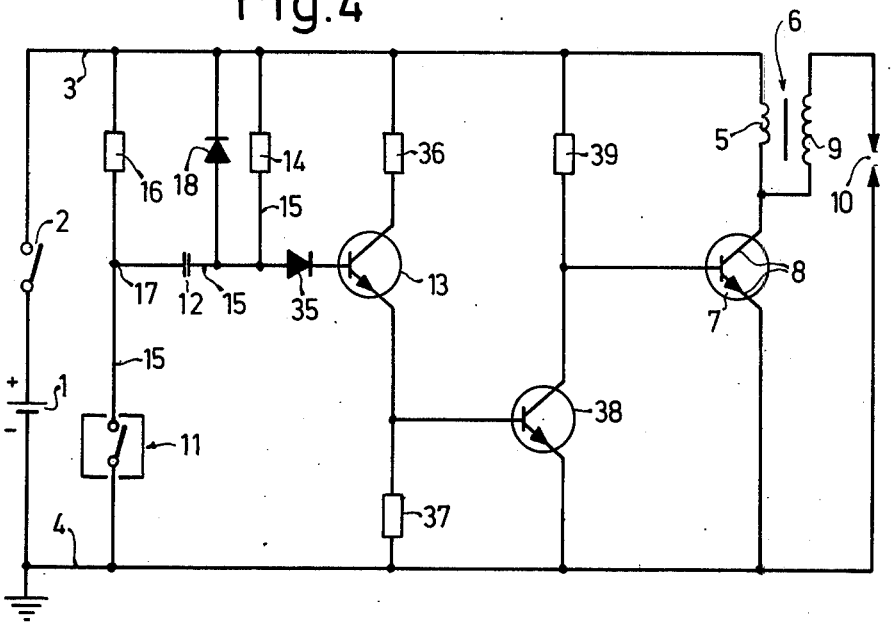

Embodiment of FIG. 4: The charge/discharge resistor 14 is connected to positive bus 3 as well as to capacitor 12; a diode 35 is connected between the resistor 14 and the base of transistor 13. The auxiliary transistor 13, of the npn type, has its collector connected through a resistor 36 to positive bus 3, and its emitter through a resistor 37 to chassis 4, as well as to the base of a coupling transistor 38 which is of the npn type, has its emmitter connected to chassis 4 and its collector to the base of main switching transistor 7 as well as through a resistor 39 to positive bus 3. The remaining elements are the same as those in FIG. 1.

Operation of circuit of FIG. 4: Capacitor 12 will charge through resistor 14 and closed switch 11 when, with the IC engine operating, switch 11 closes. This drops the bias at the base of the auxiliary transistor 13 to such an extent that its emitter-collector path will block. In dependence thereon, the emitter-collector path of coupling transistor 38 will block and cause switch path 8 of transistor 7 to become conductive. Current will flow through primary 5. When switch 11 opens, capacitor 12 will rapidly discharge through diode 18 and resistor 16 and will then recharge over resistor 16, diode 35 and the base-emitter path of transistor 13 as well as through the parallel circuit formed by resistor 37 and the base-emitter path of transistor 38. This causes auxiliary transistor 13 to become conductive, the emitter-collector path of the transistor 38 to also become conductive, and to change the switch path 8 of transistor 7 to block, thus causing an ignition spark at spark plug 10 as above described. Upon renewed closing of switch 11, the cycle will repeat.

If the ignition switch 2 is closed and the IC engine does not operate, while switch 11 is in closed state, current flowing over the capacitor 12 will decrease in accordance with its charge state. Gradually, current will flow over the base-emitter path of the auxiliary transistor 13. As a consequence, and also relatively slowly, the emitter-collector path of the coupling transistor 38 will change to current-condductive state, causing, gradually, to switch over the main path 8 of transistor 7 in blocking state. The change-over is so slow that the decrease of current through primary winding 5 does not induce a high-voltage pulse in secondary 9, and thus no arc at the spark plug 10.

Diode 35 raises the switching threshold of auxiliary transistor 13. Charge and discharge time are equally controlled as in the embodiment of FIG. 1.

Figure 5:
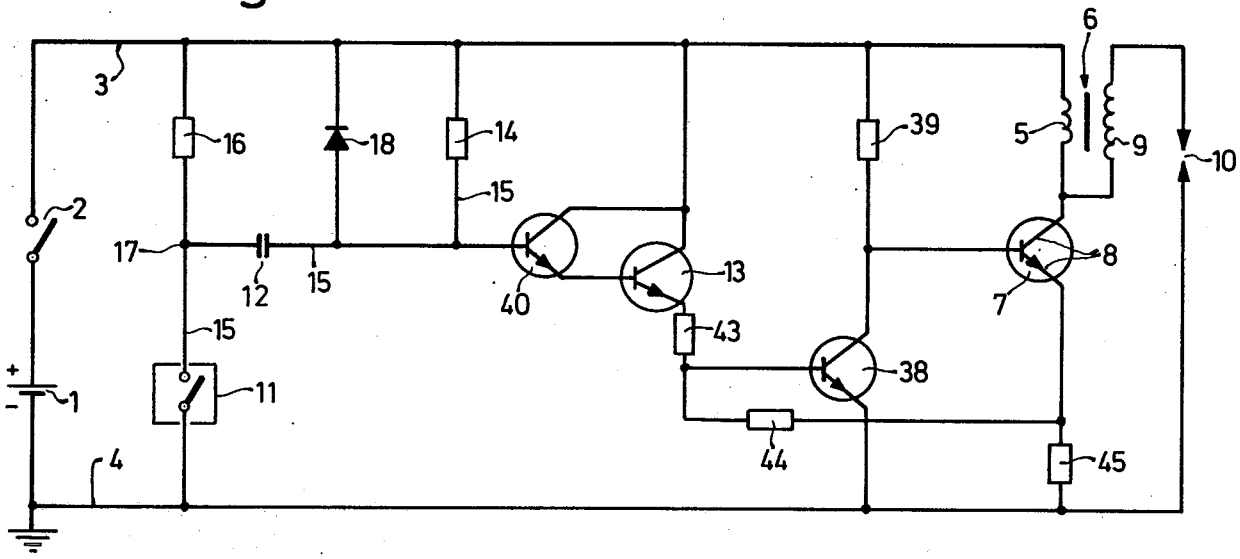

Embodiment of FIG. 5: The diode 35 and resistor 36, illustrated in FIG. 4, have been removed and a further coupling transistor has been included, combined with transistor 13, to form a Darlington circuit. The emitter of the auxiliary transistor 13 is connected to a resistor 43 and then both to the base of transistor 38 as well as through a resistor 44 to the junction of a resistor 45 and the emitter of transistor 7. The other elements are the same as those discussed in connection with FIG. 4.

The Darlington circuit of transistor 13, 40 permits use of a capacitor 12 of lower capacity value than in the embodiment of FIG. 4. The resistance value of charging resistor 14 should then be higher, thus reducing the overall costs of the system. The npn transistors are also cheaper than similar pnp transistors.

The resistor 45 acts as a sensing or monitoring resistor which checks the current flow through primary winding 5. If the current through primary winding 5 rises to an excessive value, then the voltage drop across resistor 45 will provide a further bias at the base of transistor 38 which will cause the emitter-collector path thereof to become somewhat more conductive, hence increasing the resistance of switching path 8 of transistor 7, and preventing excessive current rise in the primary winding 5. The transistion of the path 8 into blocking state causes a lower voltage drop across resistor 45. Thus, when the IC engine does not operate and the emitter-collector path of the coupling transistor 38 becomes conductive, the switching path 8 of transistor 7 will block with a slight time delay due to the branching of the currents over resistors 44, 45, further decreasing the danger of generation of a spark at spark plug 10. This arrangement may, of course, also be used in the system of FIG. 4, or any of the other Figures.

Various changes and modifications may be made, and features described in connection with any one of the embodiments may be used with any of the others, within the scope of the inventive concept.

In an operating embodiment for a 12 V (nominal) battery voltage of source 1, capacitor 12, in the embodiment of FIGS. 1, 3 and 4, and resistor 14 had the following values:

capacitor 12: 15 $\mu$ F
resistor 14: 100kω

In the embodiment of FIGS. 2 and 5, using the Darlington circuit, the following values for capacitor and resistor obtained:

capacitor 12: 6, 8 $\mu$ F
resistor 14: 270kω

We claim:

1. Transistorized ignition system for an internal combustion engine have an ignition coil (6);

a main switching transistor (7) connected in series with the primary (5) of the ignition coil (6);

an ignition breaker switch (11) connected to and controlling conduction or blocking of the switching transistor (7) in accordance with commanded ignition events;

a control capacitor (12) connected to the switching transistor (7) to control the switching transistor to non-conduction or blocked state if the engine should be stopped, with the ignition breaker switch (11) closed;

a control resistor (16) connected between the positive (3) and negative (4) terminals of a source (1) and in series with said breaker switch (11), the junction (17) between said control resistor (16) and said ignition breaker switch (11) being connected to the control capacitor (12);

a charge discharge resistor (14) forming a series connection (15) with the ignition breaker switch (11) and the control capacitor (12) between the positive (3) and negative (4) terminals of a direct current source (1);

a capacitor discharge circuit (18) connected to the control capacitor;

means connected to the control capacitor (12) and gradually changing over the conduction state of the main transistor (7) from conduction to blocking to prevent induction of a high-voltage pulse in the secondary (9) of the ignition coil (6) after the engine has stopped, comprising an auxiliary transistor (13) connected to the control capacitor (12) and a control circuit therefor gradually changing the conduction of the emitter-collector path of said auxiliary transistor, the main switching transistor (7) being connected to and controlled by said auxiliary transistor and similarly gradually changing to blocking state in dependence on the gradual change in conduction of the emitter-collector path of the auxiliary transistor (13);

a coupling transistor (32, 38) connected to and controlled by said auxiliary transistor, annd having its emitter-collector path connected in parallel to the base-emitter junction of the main switching transistor (7);

and wherein the collector of the auxiliary transistor (13) is connected to the positive terminal (3) of the source (1) — the emitter is connected to the negative terminal (h) of the source (1);

and the base of the auxiliary transistor (13) is connected to the capacitor discharge circuit the auxiliarly transistor (13) providing a control output through said coupling transistor (32, 38) to the main switching transistor (7).

2. System according to claim 1, wherein the discharge cirucit includes a discharge diode (18) poled in blocking direction with respect to the current supply (1) of the system and connected to the control capacitor (12) at the side of the control capacitor (12) remote from its connection to the ignition breaker switch (11), and said charge/discharge resistor (14).

3. System according to claim 1, wherein the series connection (15) extends: positive terminal (3) of the source (1), charge/discharge resistor (14), control capacitor (12), ignition breaker switch (11), negative terminal (4) of the source (1).

4. System according to claim 1, further comprising a driver transistor (24) connected to the auxiliary transistor in a Darlington circuit, the collectors of the driver transistor (24) and of the auxiliary resistor being connected together (FIGS.. 2, 5).

5. System according to claim 1, wherein the series connection (15) comprises: positive terminal (3) of the source (1), ignition breaker switch (11, 25), charge resistor (14), control capacitor (12), the base-emitter path of the auxiliary transistor (13) and negative terminal of the source (1), the collector of the auxiliary transistor (13) providing the control output for the coupling transistor (32) and hence for the main switching transistor (7).

6. System according to claim 1, further comprising a diode (30) poled in blocking direction with respect to the current source (1) and connected in parallel with the charge resistor (14).

7. System according to claim 1, wherein the emitter of the auxiliary transistor (13) provides the control output for the coupling transistor (38) and hence for the main switching transistor (7).

8. System according to claim 7, further comprising a diode (35) connected between the base of the auxiliary transistor (13) and the charge/discharge resistor (14) and poled in blocking direction with respect to the main current supply source (1).

9. System according to claim 7, further comprising a drive transistor (40) connected in a Darlington circuit with the auxiliary transistor (13), the collectors of said driver transistor (40) and the auxiliary transistor (13) being connected together.

10. System according to claim 1, futher comprising a resistor (45) connected in series with the emitter-collector path (8) of the main switching transistor (7);

and the coupling transistor (38) has its base connected across said monitoring resistor (45) so that the voltage drop across said monitoring resistor will additionally control conduction of said coupling transistor (38).

11. System according to claim of further comprising a coupling resistor (44) connected between the base of the coupling transistor (38) and the junction of the main current-carrying path (8) of said main switching transistor (7) said monitoring resistor (45).

* * * * *

UNITED STATES PATENT AND TRADEMARK OFFICE

CERTIFICATE OF CORRECTION

PATENT NO. : 4,130,101

DATED : December 19, 1978

INVENTOR(S) : Werner JUNDT ET AL

It is certified that error appears in the above-identified patent and that said Letters Patent are hereby corrected as shown below:

Claim 11, column 8, line 1, "system according to claim of" should be -- System according to claim 10 --

Signed and Sealed this

*Fifth* Day of *June 1979*

[SEAL]

*Attest:*

RUTH C. MASON
*Attesting Officer*

DONALD W. BANNER
*Commissioner of Patents and Trademarks*